United States Patent [19]

Moriya et al.

[11] Patent Number: 4,497,514

[45] Date of Patent: Feb. 5, 1985

[54] INSIDE-HANDLE ARRANGEMENT FOR AN AUTOMOTIVE VEHICLE DOOR ASSEMBLY

[75] Inventors: Masaichi Moriya, Chigasaki; Osamu Seko, Yokohama, both of Japan

[73] Assignees: Nissan Motor Company, Limited, 03; Ohi Seisakusho Co., Ltd., both of Yokohama, Japan

[21] Appl. No.: 375,010

[22] Filed: May 5, 1982

[30] Foreign Application Priority Data

May 6, 1981 [JP] Japan ..... 56-66851

[51] Int. Cl.[3] ..... E05B 3/00

[52] U.S. Cl. ..... 292/336.3; 292/DIG. 38; 292/DIG. 53; 16/112; 16/DIG. 32

[58] Field of Search ..... 292/336.3, DIG. 38, 292/221, DIG. 53, DIG. 31; 16/DIG. 32, 110 R, 112, 123, 126, DIG. 30

[56] References Cited

U.S. PATENT DOCUMENTS

| | | | |
|---|---|---|---|
| 3,528,695 | 9/1970 | Peters | 292/336.3 |
| 4,038,718 | 8/1977 | Reilhac et al. | 292/336.3 X |
| 4,054,307 | 10/1977 | Carella et al. | 292/336.3 X |
| 4,099,757 | 7/1978 | Palmer et al. | 292/336.3 |
| 4,343,501 | 8/1982 | Meeks | 292/336.3 |

FOREIGN PATENT DOCUMENTS

| | | | |
|---|---|---|---|
| 921594 | 3/1963 | United Kingdom | 292/336.3 |
| 1398981 | 6/1975 | United Kingdom | 292/336.3 |

*Primary Examiner*—Richard E. Moore
*Assistant Examiner*—Thomas J. Dubnicka
*Attorney, Agent, or Firm*—Schwartz, Jeffery, Schwaab, Mack, Blumenthal & Koch

[57] ABSTRACT

An inside-handle arrangement for the vehicle door assembly has a member, for pivotably securing a handle onto a door inner panel, with a circumferential edge capable of air-tight engagement with a door trim. Further, the member is adapted to close in an air-tight fashion an opening through which the handle is received using a portion of the handle for providing the air-blocking arrangement.

26 Claims, 7 Drawing Figures

INSIDE-HANDLE ARRANGEMENT FOR AN AUTOMOTIVE VEHICLE DOOR ASSEMBLY

BACKGROUND OF THE INVENTION

The present invention relates generally to a door handle arrangement for an automotive vehicle door assembly. More particularly, the invention relates to an inside-handle arrangement isolating the interior of the vehicle compartment from the exterior for prohibiting admission of ambient air.

An automotive vehicle door assembly generally comprises a door outer panel, a door inner panel to which an inside-door handle is fixed, a door lock mechanism, and a window regulator device. A door trim is also attached to the door inner panel. The door outer panel and door inner panel define a hollow clearance therebetween. Ambient air is apt to be admitted into this clearance through externally exposed openings and/or gaps formed in the door assembly. The ambient air admitted into the inside of the door assembly tends to blow into the interior of the vehicle compartment through a gap between the inside-handle arrangement and the door inner panel to create a blow-noise. Furthermore, the ambient air is apt to introduce dust, dirt, etc. into the vehicle compartment.

SUMMARY OF THE INVENTION

Therefore, it is an object of the present invention to provide an inside-handle arrangement for an automotive vehicle door assembly, which arrangement can effectively eliminate induction of ambient air into the vehicle compartment.

Another and more specific object of the present invention is to provide an inside-handle arrangement isolating the interior of the vehicle compartment from the exterior thereof for preventing the introduction of ambient air into the vehicle compartment.

The above-mentioned and other objects can be accomplished with an inside-handle arrangement for the vehicle door assembly which has a member for pivotably securing a handle onto a door inner panel, with a circumferential edge capable of substantially air-tight engagement with the door trim. Further, the member is adapted to close an opening through which the handle is received with a portion of the handle when positioned in a normal (closed) position in a substantially air-tight or air-blocking fashion.

According to one embodiment of the present invention, there is provided an inside-handle arrangement comprising: a door latch mechanism incorporated in a door lock mechanism, an inside handle co-operatively associated with the door latch mechanism and being movable between a first normal position and a second operated position, a bracket for pivoting the inside handle onto a door panel, which bracket is formed with an opening for receiving one end of the inside handle and permitting the latter to move between the first and second position, and means for closing the opening including a portion of the inside handle adapted to contact with a circumferential portion of the opening to establish air-tight closure therebetween at least when the inside handle is in the first position.

BRIEF DESCRIPTION OF THE DRAWINGS

The invention will be understood more fully from the detailed description given herebelow and from the accompanying drawings of the preferred embodiment of the present invention, which, however, should not be taken as limitative to the invention but for explanation or elucidation only.

In the drawings.

DETAILED DESCRIPTION OF THE PREFERRED EMBODIMENTS

Figure 1:
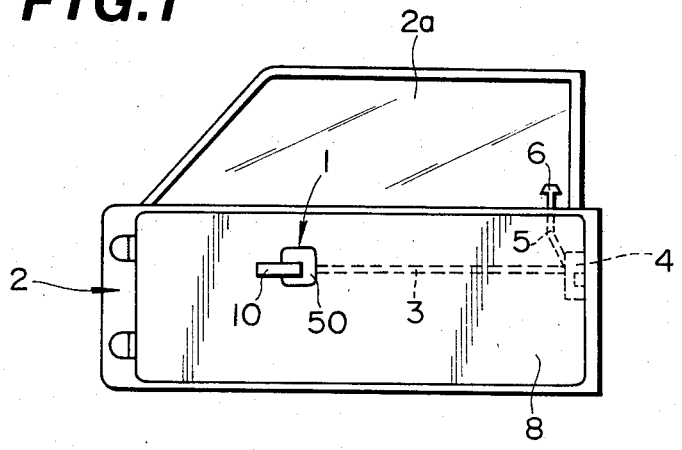
FIG. 1 is a front elevation of a vehicle door assembly with a preferred embodiment of an inside-handle arrangement according to the present invention.

Referring now to the drawings, particularly to FIG. 1, there is illustrated a general construction of a vehicle door assembly 2 with the preferred embodiment of an inside-handle arrangement 1 according to the present invention. The inside-handle arrangement 1 has a handle 10 connected to a per se well known door lock assembly 4 through a connecting rod or link 3. On the other hand, the door lock assembly 4 is connected to a door lock knob 6 via another connecting rod or link 5. The connecting rods 3 and 5 are inserted in a clearance defined between a door inner panel 9 (visible in FIGS. 3A and 4 for example) and a door trim 8. The connecting portion of the handle 10 and the connecting rod 3 are covered with an inside-handle escutcheon 50.

Figure 3A:
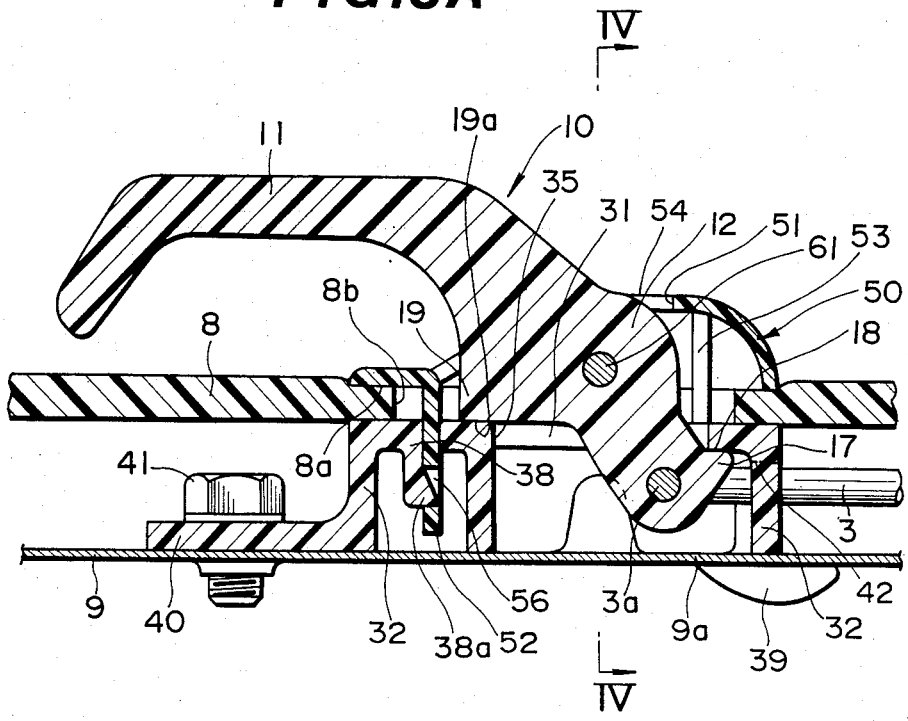
FIG. 3A is a longitudinal section of the inside-handle arrangement of FIG. 1 in the latching position.
Figure 3B:
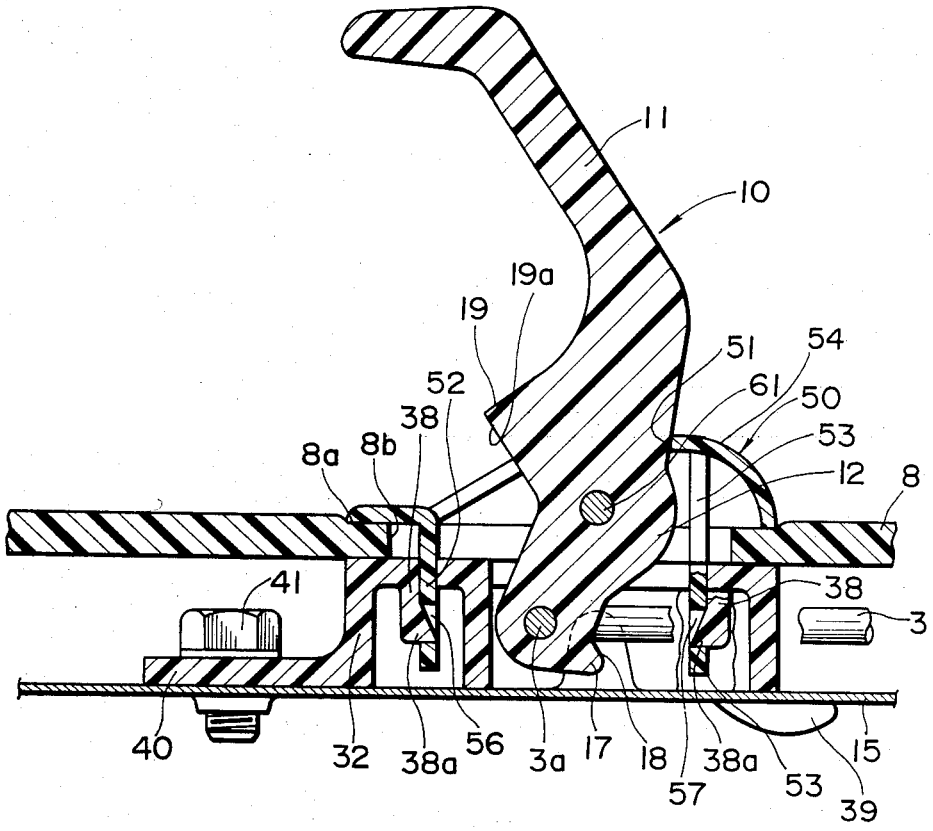
FIG. 3B is a longitudinal section of the inside-handle arrangement of FIG. 1 in the unlatching position.

As is well known, the door lock assembly 4 includes a latch mechanism for latching the vehicle door assembly in closed position, and a locking mechanism for locking the door assembly in the closed position. The latching mechanism is connected to the connecting rod 3 via an operation lever thereof and the locking mechanism is connected to the connecting rod 5 via the operation rod thereof. In the embodiment shown, the door lock knob 6 is provided at the upper edge of the door assembly 2 and protrudes toward the door window portion 2*a*. The door is locked when knob 6 is at the lower position thereof and unlocked when knob 6 is at the raised position, while the latch mechanism is normally urged to the unlatching position so that it may engage with a striker (not shown) provided in a vehicle body and held at an engaged position with a locking plate (not shown) to latch the door at the closed position of the door assembly in order to keep the door assembly at the latched position. Therefore, the handle 10 is resiliently urged to a position corresponding to the position as shown in FIG. 3 in the normal position. The handle 10 is operable to the position as shown in FIG. 3B by rotation thereof about a pivot to operate the latch mechanism to release engagement with the striker by releasing the locking plate from engagement.

Figure 2:
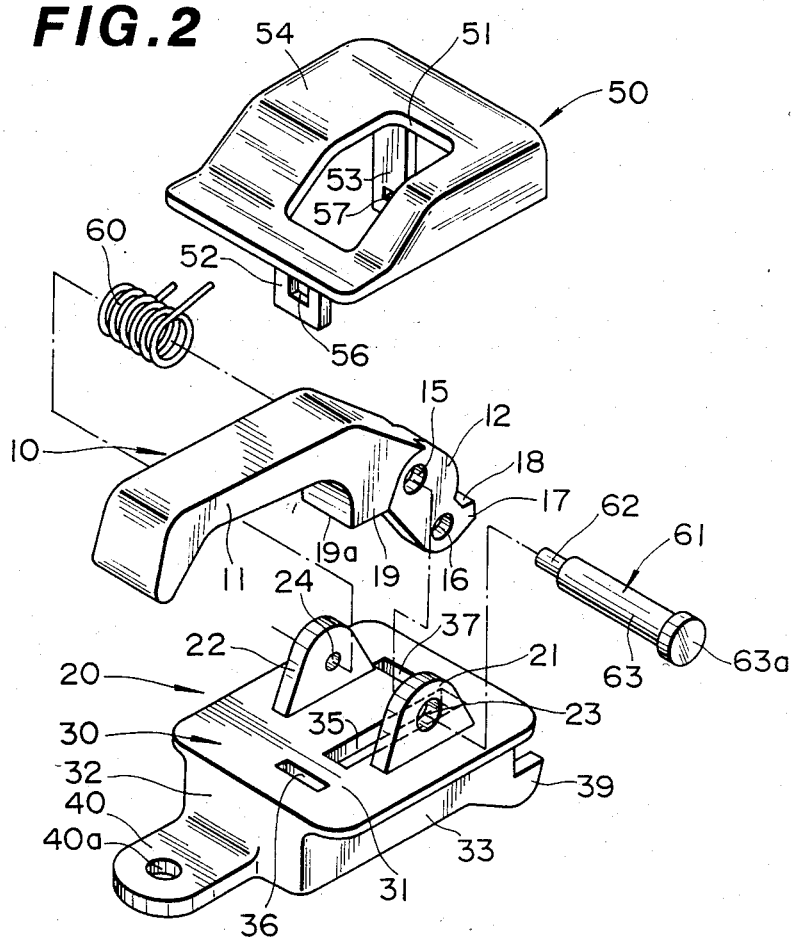
FIG. 2 is an enlarged and exploded perspective view of the inside-handle arrangement of FIG. 1.
Figure 4:
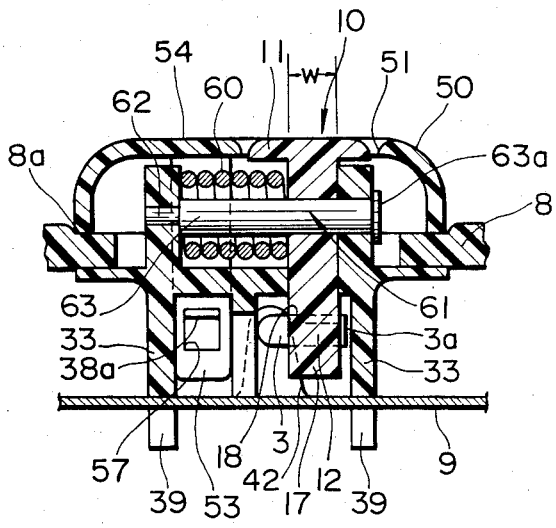
FIG. 4 is a cross-section of the inside-handle arrangement taken along line IV—IV of FIG. 3A.

FIGS. 2 to 4 show the preferred embodiment of the inside-handle arrangement 1. The inside-handle arrangement 1 generally comprises the handle 10, a bracket member 20 and an inside-handle escutcheon 50, respectively formed of a rigid synthetic resin such as polyvinyl acetal.

As shown in FIG. 2, the handle 10 generally comprises a grip section 11 and a pivot section 12. The pivot section 12 is formed with through openings 15 and 16 and has an extension 17 having a plane contact surface 18. On the other hand, the bracket member 20 has a pair of hinge sections 21 and 22 protruded from the major section 30. The pair of hinge sections 21 and 22 are spaced apart from each other to define a clearance therebetween to receive the pivot section 12 of the handle 10. The hinge sections 21 and 22 are formed with through openings 23 and 24. The opening 23 is formed larger than the opening 24.

The major section 30 of the bracket member 20 comprises a plane section 31 opposing to the handle 10 and vertical sections 32 and 33 extended from the plane section 31 vertically with respect to the plane section. In the plane section 31 are formed three substantially rectangular openings 35, 36 and 37. The opening 35 extends parallel to the hinge section 21 and is adapted to permit the end of the pivot section 12 to pass therethrough. The opening 35 further permits the end of the pivot section 12 to move freely thereabout. As shown in FIG. 3, the bracket member 20 has projections 38 with hooks 38*a* at the free end thereof extending from the plane section in the direction opposite to that of the hinge section being extending. One projection 38 is located adjacent the opening 36 and is normally urged towards the right as shown in FIG. 3. Another projection 38 of section 31 is located adjacent the opening 37 and normally biased towards the left in FIG. 3, (also see FIG. 3B and 4). A pair of extensions 39 are extended from the vertical sections 33. A projection 40 with a through opening 40*a* is laterally extended from the vertical section 32. The projection 40 serves as a fitting section to secure the bracket member 20 onto a door inner panel 9 with a fastening bolt 41. The door inner panel 9 is thus formed with a threaded opening to receive the fastening bolt engaging thereto. The door inner panel is also formed with a pair of slits 9*a* to pass the extensions 39 and to help secure the bracket member 20 onto the door inner panel.

Further, as shown in FIG. 4, the lateral width W of the opening 35 approximately corresponds to the width of the pivot section 12 of the handle 10 so that the side surface of the pivot section contacts the periphery of the opening so tightly as to establish slidable and air-blocking contact therebetween.

The inside-handle escutcheon 50 is formed with a substantially rectangular opening 51 to pass the handle 10 therethrough. The escutcheon 50 is further provided with extensions 52 and 53 respectively extended laterally from the major section 54 of the escutcheon. The extension 52 is adapted to engage with the opening 36 and the extension 53 is adapted to engage with the opening 37. Both of the extensions 52 and 53 contact the peripheral edge of the openings 36 and 37 to establish air-blocking contact therebetween. The extensions 52 and 53 are formed with openings 56 and 57 respectively to engage with hooks 38*a* of the projections 38 to secure the escutcheon 50 on the bracket member 20. On the other hand, the bracket member 20 is formed with an opening 42 through which the end of the connecting rod 3 extends into the inside of the inside-handle arrangement to engage with the handle 10. The end 3*a* of the connecting rod 3 is turned at about a right angle and is engageable with the opening 16 of the pivot section 12 of the handle 10.

A torsion spring 60 is interposed between the pair of hinge sections 21 and 22 in alignment of the axis thereof with the axes of the openings 23 and 24. As apparent from FIG. 2, the opening 23 is larger than the opening 24. A pivot pin 61 has one end 62 with a smaller diameter than that of the remaining major part 63 and the other end provided with a flanged head 63*a*. The opening 24 is adapted to receive the end 62 of the pivot pin and the opening 23 is adapted to receive the major section 63. The pivot pin 61 also passes through the opening 15 of the pivot section 12 of the handle 10. As seen from FIG. 4, the pivot section of the handle 10 is located adjacent the hinge section 21 in side-by-side relationship with the torsion spring 60. The torsion spring 60 has one end engaging with the upper face of the major section 30 of the bracket member 20 and the other end engaging with the handle 10. By this arrangement, the torsion spring 60 provides for the handle 10 a rotational torque for urging the handle in a counterclockwise direction with respect to FIG. 3A.

During assembly, the pivot section 12 of the handle 10 is inserted into the clearance between the hinge sections 21 and 22 of the bracket member 20 and further extends inwardly through the opening 35. The torsion spring 60 is then interposed between the hinge section 22 and the pivot section 12 in alignment with the axis of the openings 23 and 24 of the hinge sections 21 and 22. The opening 15 of the pivot section 12 is positioned with the axis thereof in alignment with the axes of the openings 23 and 24 of the hinge sections 21 and 22. Then, the pivot section 12 is pivotably secured onto the hinge sections 21 and 22 by the pivot pin 61. The small diameter end 62 is then engaged with the opening 24, and the top thereof is clamped in order to prevent the pivot pin from becoming loose. As set forth, the one end of the torsion spring 60 is engaged with the upper surface of the plane section 31 of the bracket member 20 and the other end is engaged with the handle 10 so that it may provide rotational torque to normally urge the handle in the position of FIG. 3A. At this position, the end 3*a* of the connecting rod 3 passes through the opening formed in the bracket member 20 and is engaged with the opening 16 of the pivot section 12. Thus, the handle 10 is connected to the latch mechanism of the door lock assembly 4.

Thereafter, the extensions 39 of the bracket member 20 are respectively engaged with slits 9*a* of the door inner panel to attach the bracket member onto the door inner panel. Here, the bracket member 20 is fixedly secured onto the door inner panel by engagement of the fastening bolt 41 passing through the opening of the projection 40 with the threaded opening of the door inner panel 9. Then, the door trim 8 is fitted to the door inner panel 9 in spaced-apart relationship therefrom as shown in FIG. 3. Then, the inside-handle escutcheon 50 is fitted onto the door trim 8 to urge the door trim toward the plane surface of the bracket member 20. The circumferential edge of the escutcheon 50 is fitted onto the circumferential of the rest 8*a* formed around the opening 8*b* to pass the handle therethrough. The extensions 52 and 53 are then inserted through the openings 36 and 37 of the bracket member 20. The openings 56 and 57 of the extensions 52 and 53 respectively receive the hooks 38*a* of the projections 38 of the bracket member 20, which extensions 52 and 53 are respectively elastically urged toward extensions 38.

In the assembled condition, the plane contact surface 18 of the extension 17 abuts against the inner surface of the plane section 31 of the bracket member 20 at one edge of the opening 35 to establish a substantially air-tight or air blocking contact therebetween as shown in FIG. 3A. At the same time, a surface 19*a* of a portion 19 of the pivot section 12 contacts with the upper surface of the plane section 31 at the other edge of the opening 35 to also establish a substantially air-tight or air-blocking contact therebetween. By this, the opening is closed in an air-tight or air-blocking fashion to block the air introduced from the exterior of the vehicle and flowing in the clearance between the door inner and outer panels.

In the preferred embodiment, the portions constituting the contacting surfaces 18 and 19*a*, and/or the surfaces of the plane section 31 to which the contacting surfaces 18 and 19*a* contact, are made of an elastic member such as rubber for establishing a substantially air-tight or air-blocking contact.

Figure 5:
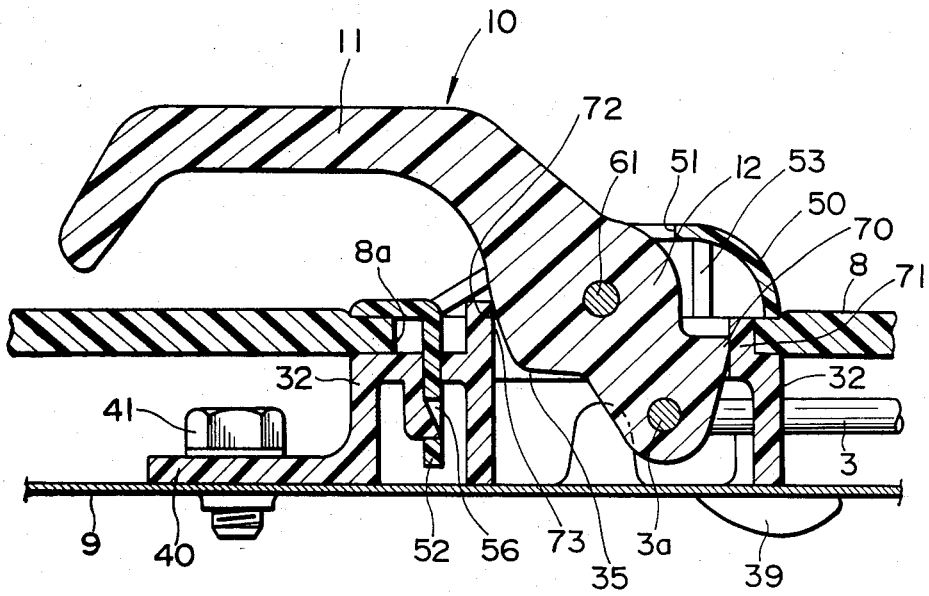
FIG. 5 is a longitudinal section of the second embodiment of the inside-handle arrangement of the present invention.

FIG. 5 shows the second embodiment of the inside-handle arrangement of the present invention. The second embodiment shows a modification of the closure structure for closing the opening of the bracket member. In this embodiment, the elements and parts corresponding to the those of the foregoing first embodiment are represented by the same reference numerals in order to simplify the explanation given herebelow. The pivot section 12 is adapted to contact a portion 70 to a vertical section 71 of the major section 30 of the bracket member 20. On the other hand, the portion 72 of the pivot section 12 of the handle 10 contacts to the edge 73 of the opening 35. By this arrangement, the pivot section 12 establishes an airtight closure for closing the opening 35.

Figure 6:
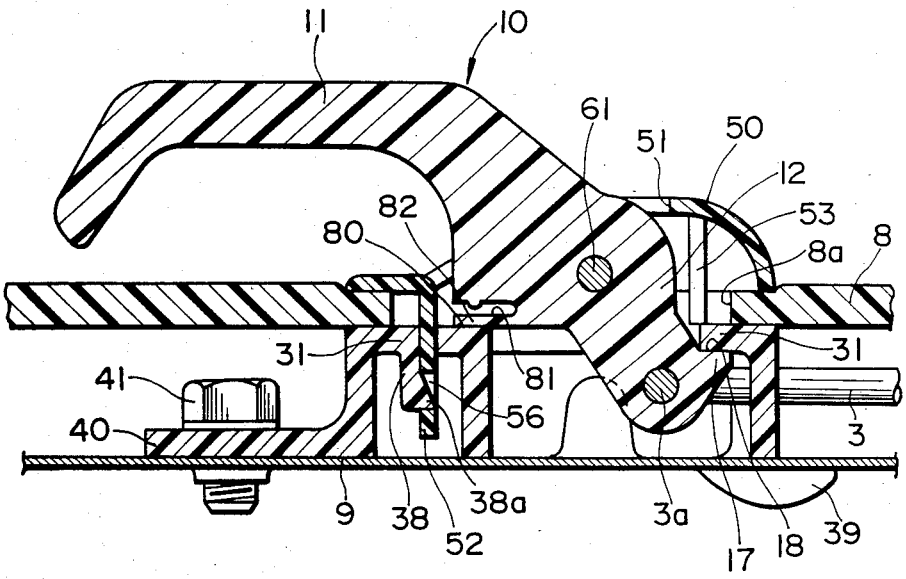
FIG. 6 is a longitudinal section of the third embodiment of the inside-handle arrangement of the present invention.

FIG. 6 shows the third embodiment showing the other modification of the closure structure of the opening 35. The closure structure of this embodiment is similar to the foregoing first embodiment as apparent from FIG. 6. In this embodiment, the portion 80 making contact with the upper surface of the plane section 31 of the bracket member 20 is formed with a substantially U-shaped groove 81. By this groove, a contact strip 82 is defined opposing to the upper surface of the plane section 31. The contact strip 82 elastically contacts with the upper surface to ensure establishment of air-tight contact therebetween.

Thus, the present invention as disclosed hereabove can fulfill all of the aforementioned objects.

While the invention has been described in detail with respect to specific embodiments of the invention, it should not be understood as limited to the specific embodiments recited hereabove and should be understood to include all possible modifications and other embodiments otherwise embodying the invention without departing from the principle of the invention.

What is claimed is:

1. An inside handle arrangement for operating a door latch mechanism of an automotive vehicle door assembly, comprising:

an inside handle co-operatively associated with said door latch mechanism and movable between a first normal position and a second operated position;

a bracket fixed to a door panel for pivoting said inside handle adjacent said door panel, said bracket having an opening for receiving one end of said inside handle and permitting said inside handle to move between said first and second positions; and means for closing said opening, said closing means including a portion of said inside handle adapted to contact a portion of said bracket adjacent said opening to establish an air-blocking closure therebetween at least when said inside handle is in said first position.

2. An inside handle arrangement for operating a door latch mechanism of an automotive vehicle door assembly, comprising:

an inside handle co-operatively associated with said door latch mechanism and movable between a first normal position and a second operated position;

a door trim provided adjacent a door panel;

a bracket for pivoting said inside handle adjacent said door panel, said bracket having an opening for receiving one end of said inside handle and permitting said inside handle to move between said first and second positions;

means for closing said opening, said closing means including a portion of said inside handle adapted to contact a portion of said bracket adjacent said opening to establish an air-blocking closure therebetween at least when said inside handle is in said first position; and a cover member attached to said bracket and urging said door trim onto said bracket to establish air-blocking closure therebetween.

3. The arrangement as set forth in claim 1 or 2, wherein said inside handle is provided with a portion establishing an air-tight contact with a circumferential edge of said opening of said bracket.

4. The arrangement as set forth in claim 1 or 2, wherein said inside handle is provided with a portion establishing an air-tight contact with an inner periphery of said opening of said bracket.

5. The arrangement as set forth in claim 3, wherein said inside handle has a portion resiliently urged toward the circumference of said opening to establish an air-tight contact.

6. The arrangement as set forth in claim 4, wherein said inside handle has side surfaces tightly and slidably in contact with opposing periphery of said opening to establish air-blocking closure therebetween.

7. The arrangement as set forth in claim 5, wherein said inside handle has side surfaces tightly and slidably in contact with opposing periphery of said opening to establish air-blocking closure therebetween.

8. The arrangement as set forth in claim 6, wherein said bracket includes means for defining therein a space for receiving therein a spring urging said inside handle in said first position.

9. The arrangement as set forth in claim 7, wherein said bracket includes means for defining therein a space for receiving therein a spring urging said inside handle in said first position.

10. The arrangement as set forth in claim 3, further comprising a cover member having a leg member resiliently engageable with said bracket for attaching the circumferential edge thereon with said door trim to urge the door trim onto said bracket in an air-tight fashion.

11. An inside handle arrangement for operating a door latch mechanism of an automotive vehicle door assembly, comprising:

a door panel;

a door trim attached to said door panel with a clearance defined therebetween;

an inside handle including a grip portion and a pivot portion, said inside handle being associated with said door latch mechanism and movable between a first normal position and a second operated position;

a bracket rigidly secured to said door panel and defining an opening to receive said pivot portion of said inside handle, said bracket including means for pivoting said inside handle thereabout;

means for closing said opening in an air-blocking fashion, said closing means including a first portion of said pivot portion contacting a portion of said bracket adjacent said opening; and a cover member engageable with said bracket and having a circumferential edge thereon adapted to urge said door trim: onto said bracket in an air-blocking fashion.

12. An inside handle arrangement for operating a door latch mechanism of an automotive vehicle door assembly, comprising:

a door panel;

a door trim attached to said door panel with a clearance defined therebetween;

an inside handle including a grip portion and a pivot portion, said inside handle being associated with said door latch mechanism and movable between a first normal position and a second operated position;

a bracket having an opening to receive said pivot portion of said inside handle, and means for pivoting said inside handle thereabout;

means for closing said opening in air-blocking fashion, said closing means including a first portion of said pivot portion contacting a portion of said bracket adjacent said opening; and a cover member attachable to said bracket and urging said door trim onto said bracket to establish air blocking closure therebetween.

13. The arrangement as set forth in claim 11 or 12, wherein said inside handle is provided with a portion establishing an air-tight contact with a circumferential edge of said opening of said bracket.

14. The arrangement as set forth in claim 11 or 12, wherein said inside handle is provided with a portion establishing an air-tight contact with an inner periphery of said opening of said bracket.

15. The arrangement as set forth in claim 13, wherein said inside handle has a portion resiliently urged toward the circumference of said opening to establish an air-tight contact.

16. The arrangement as set forth in claim 14, wherein said inside handle has side surfaces tightly and slidably in contact with opposing periphery of said opening to establish air-blocking closure therebetween.

17. The arrangement as set forth in claim 15, wherein said inside handle has side surfaces tightly and slidably in contact with opposing periphery of said opening to establish air-blocking closure therebetween.

18. The arrangement as set forth in claim 16, wherein said bracket includes means for defining therein a space for receiving therein a spring urging said inside handle in said first position.

19. The arrangement as set forth in claim 17, wherein said bracket includes means for defining therein a space for receiving therein a spring urging said inside handle in said first position.

20. The arrangement as set forth in claim 13, wherein said cover member has a leg member resiliently engageable with said bracket for attaching the circumferential edge thereof with said door trim to urge the door trim onto said bracket in an air-tight fashion.

21. An inside handle arrangement for operating a door latch mechanism of an automotive vehicle door assembly, comprising:

a door panel;

a bracket rigidly secured to a surface of said door panel facing a vehicle cabin, said bracket having a second portion at which the bracket is secured to said door panel, a first portion perpendicularly extending from said second portion, and a third portion connected to said first portion and essentially parallel to said door panel, an enclosed space being defined by said first portion, said third portion, and said door panel, and a through opening being defined in said third portion; and an inside handle associated with a door latch mechanism and operative between a first normal position and a second operated position, said door handle having a pivot portion extending into said enclosed space through said opening, said pivot portion being formed such that said handle can move between said first and second positions, said pivot portion having one external surface contacting the corresponding periphery of said opening in air-blocking fashion, and the other external surface contacting the correspondiug periphery of said opening in said first position of said handle in air-blocking fashion.

22. The arrangement as set forth in claim 21, wherein said third portion of said bracket has an essentially plane surface lying essentially parallel to said door panel, and said inside handle has a corresponding essentially plane surface on said other external surface thereof.

23. The arrangement as set forth in claim 21 or 22, wherein said bracket is formed with a hook portion in said second portion, said hook portion being engageable with a slot formed in said door panel for fixing said bracket on the door panel.

24. The arrangement as set forth in claim 21 or 22, wherein said first, second and third portions of said bracket are formed integrally with each other.

25. The arrangement as set forth in claim 21 or 22, further comprising a door trim provided inside of said door panel and located in spaced-apart relationship to said door panel, and said bracket being interposed between said door panel and said door trim for serving as a spacer therebetween.

26. The arrangement as set forth in claim 25 further comprising a cover member engageable with said bracket and adapted to hold the door trim in contact with said third portion.

* * * * *